US010890858B2

(12) United States Patent
Yada et al.

(10) Patent No.: US 10,890,858 B2
(45) Date of Patent: Jan. 12, 2021

(54) DEVELOPMENT DEVICE

(71) Applicant: BROTHER KOGYO KABUSHIKI KAISHA, Nagoya (JP)

(72) Inventors: Kengo Yada, Seki (JP); Keigo Nakajima, Nagoya (JP); Shota Iriyama, Toyokawa (JP); Kazuaki Ooka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/568,548

(22) Filed: Sep. 12, 2019

(65) Prior Publication Data

US 2020/0285170 A1 Sep. 10, 2020

(30) Foreign Application Priority Data

Mar. 6, 2019 (JP) ..... 2019-040579
Mar. 6, 2019 (JP) ..... 2019-040580

(51) Int. Cl.
*G03G 15/08* (2006.01)

(52) U.S. Cl.
CPC ..... *G03G 15/0812* (2013.01); *G03G 15/0817* (2013.01); *G03G 15/0898* (2013.01)

(58) Field of Classification Search
CPC ..... G03G 15/0812; G03G 15/0817; G03G 15/0898
See application file for complete search history.

(56) References Cited

U.S. PATENT DOCUMENTS 6,212,348 B1 * 4/2001 Inoue ..... G03G 15/0812 399/284
2003/0123899 A1 * 7/2003 Kamimura ..... G03G 15/0817 399/103
2004/0120734 A1 * 6/2004 Okamoto ..... G03G 15/0812 399/284
2005/0276627 A1 * 12/2005 Nozawa ..... G03G 15/0898 399/103
2006/0171747 A1 * 8/2006 Ishii ..... G03G 15/0812 399/284
2006/0291895 A1 * 12/2006 Fukuta ..... G03G 15/0812 399/103

(Continued)

FOREIGN PATENT DOCUMENTS

JP 61-185772 A 8/1986
JP 7-160116 A 6/1995

(Continued)

*Primary Examiner* — Carla J Therrien
(74) *Attorney, Agent, or Firm* — Merchant & Gould P.C.

(57) ABSTRACT

A development device includes a layer thickness regulating blade including a support sheet metal, a blade rubber section, and a side edge seal, the support sheet metal having a first end portion, a second end portion, and a center portion between the first end portion and the second end portion, in an axial direction of a development roller. In a width direction of the support sheet metal, the first end portion of the support sheet metal in the axial direction is shorter than the center portion of the support sheet metal in the axial direction. In the width direction, a distal-end edge of the first end portion of the support sheet metal is closer to a base end portion of the support sheet metal than a distal-end edge of the blade rubber section.

11 Claims, 10 Drawing Sheets

(56) References Cited

U.S. PATENT DOCUMENTS

| | | | | |
|---|---|---|---|---|
| 2015/0110520 | A1 | 4/2015 | Tosuji et al. | |
| 2015/0110521 | A1 | 4/2015 | Tosuji et al. | |
| 2015/0277278 | A1* | 10/2015 | Yoshizumi ..... | B23K 26/0869 399/284 |
| 2018/0284648 | A1* | 10/2018 | Fukatsu ..... | G03G 15/0812 |
| 2019/0064697 | A1* | 2/2019 | Harada ..... | G03G 15/0808 |

FOREIGN PATENT DOCUMENTS

| | | | |
|---|---|---|---|
| JP | 2005-274644 | A | 10/2005 |
| JP | 2014-174462 | A | 9/2014 |
| JP | 2015-81957 | A | 4/2015 |
| JP | 2015-108800 | A | 6/2015 |

* cited by examiner

DEVELOPMENT DEVICE

CROSS-REFERENCE TO RELATED APPLICATION

This application claims priority under 35 U.S.C. § 119 from Japanese Patent Applications No. 2019-040580 filed on Mar. 6, 2019 and No. 2019-040579 filed on Mar. 6, 2019. The entire subject matters of the applications are incorporated herein by reference.

BACKGROUND

Technical Field

Aspects of the present disclosure are related to a development device.

Related Art

Heretofore, a development device has been known that includes a housing, a development roller, and a layer thickness regulating blade. The housing is configured to store toner. The development roller is supported by the housing. The development roller is rotatable around an axis extending along an axial direction of the development roller. The development roller is configured to carry toner on a circumferential surface thereof. The layer thickness regulating blade is supported by the housing.

The layer thickness regulating blade includes a support sheet metal, a blade rubber section, and side edge seals. The blade rubber section is supported by the support sheet metal. The blade rubber section has a contact portion configured to contact the circumferential surface of the development roller. The side edge seals are supported by both end portions of the support sheet metal in the axial direction, respectively. Each of the side edge seals is disposed adjacent to the blade rubber section. The side edge seals are configured to contact the circumferential surface of the development roller.

SUMMARY

In the known development device, each of the side edge seals is compressed between the support sheet metal and the development roller in a thickness direction of the side edge seals, and fills and seals a gap between the support sheet metal and the development roller. A repulsive force from each compressed side edge seal acts on the support sheet metal and the development roller. The repulsive force from each side edge seal functions as a seal pressure for causing each side edge seal to closely contact the support sheet metal and the development roller. An adequate seal pressure enables the side edge seals to prevent leakage of toner from the gap between the support sheet metal and the development roller.

In the known development device, the support sheet metal is a flat plate, and the development roller is formed in a cylindrical shape. Hence, the gap between the support sheet metal and the development roller becomes the narrowest at a nip portion between the blade rubber section and the development roller. Therefore, each side edge seal is the most compressed at the nip portion between the blade rubber section and the development roller.

At the nip portion between the blade rubber section and the development roller, it is desired to optimize a balance between a contact pressure acting between the blade rubber section and the development roller and the seal pressure of the side edge seals.

However, in the known development device, it is difficult to optimize the balance between the contact pressure acting between the blade rubber section and the development roller and the seal pressure of the side edge seals.

The reason why it is difficult to optimize the balance between the contact pressure and the seal pressure is as follows. For instance, a center portion of the support sheet metal in the axial direction has the same width as a first end portion of the support sheet metal in the axial direction. It is noted that the center portion of the support sheet metal in the axial direction supports the blade rubber section. Further, the first end portion of the support sheet metal in the axial direction supports one of the side edge seals. Hence, in a width direction of the support sheet metal, an edge of a distal end portion of the support sheet metal is positioned equally at both the center portion and the first end portion of the support sheet metal in the axial direction. Further, in the width direction, the edge of the distal end portion of the support sheet metal is spaced apart from the nip portion between the blade rubber section and the development roller.

Therefore, when the seal pressure of each side edge seal is optimized at the distal end portion of the support sheet metal, the seal pressure of each side edge seal is made too high at the nip portion between the blade rubber section and the development roller.

Consequently, due to such a too high seal pressure of each side edge seal at the nip portion between the blade rubber section and the development roller, the contact pressure acting between the blade rubber section and the development roller might be made excessively lower, or the blade rubber section might be separated from the development roller. Thereby, toner might leak from the gap between the blade rubber section and the development roller.

Aspects of the present disclosure are advantageous to provide one or more improved techniques for a development device that make it possible to prevent leakage of toner from a gap between a blade rubber section and the development roller.

According to aspects of the present disclosure, a development device is provided, which includes a housing configured to store toner, a development roller supported by the housing, the development roller being rotatable around an axis extending along an axial direction of the development roller, the development roller being configured to carry the toner from the housing on a circumferential surface of the development roller, and a layer thickness regulating blade supported by the housing. The layer thickness regulating blade includes a support sheet metal having a distal end portion and a base end portion in a width direction of the support sheet metal, the base end portion being attached to the housing, the support sheet metal having a first end portion, a second end portion, and a center portion between the first end portion and the second end portion, in the axial direction, a blade rubber section supported by the center portion of the support sheet metal in the axial direction, the blade rubber section being configured to contact the circumferential surface of the development roller, and a first side edge seal supported by the first end portion of the support sheet metal in the axial direction, the first side edge seal being adjacent to the blade rubber section in the axial direction, the first side end seal being configured to contact the circumferential surface of the development roller, the first side edge seal being pinched and compressed between the support sheet metal and the development roller. In the width direction, the first end portion of the support sheet metal in the axial direction is shorter than the center portion of the support sheet metal in the axial direction, the width direction being a direction from the base end portion of the support sheet metal toward the distal end portion of the support sheet metal. In the width direction, a distal-end edge of the first end portion of the support sheet metal is closer to the base end portion of the support sheet metal than a distal-end edge of the blade rubber section, the distal-end edge of the first end portion of the support sheet metal being an edge closer to the distal end portion of the support sheet metal among two edges of the first end portion in the width direction, the distal-end edge of the blade rubber section being an edge closer to the distal end portion of the support sheet metal among two edges of the blade rubber section in the width direction.

BRIEF DESCRIPTION OF THE ACCOMPANYING DRAWINGS

DETAILED DESCRIPTION (General Overview)

Figure 1:
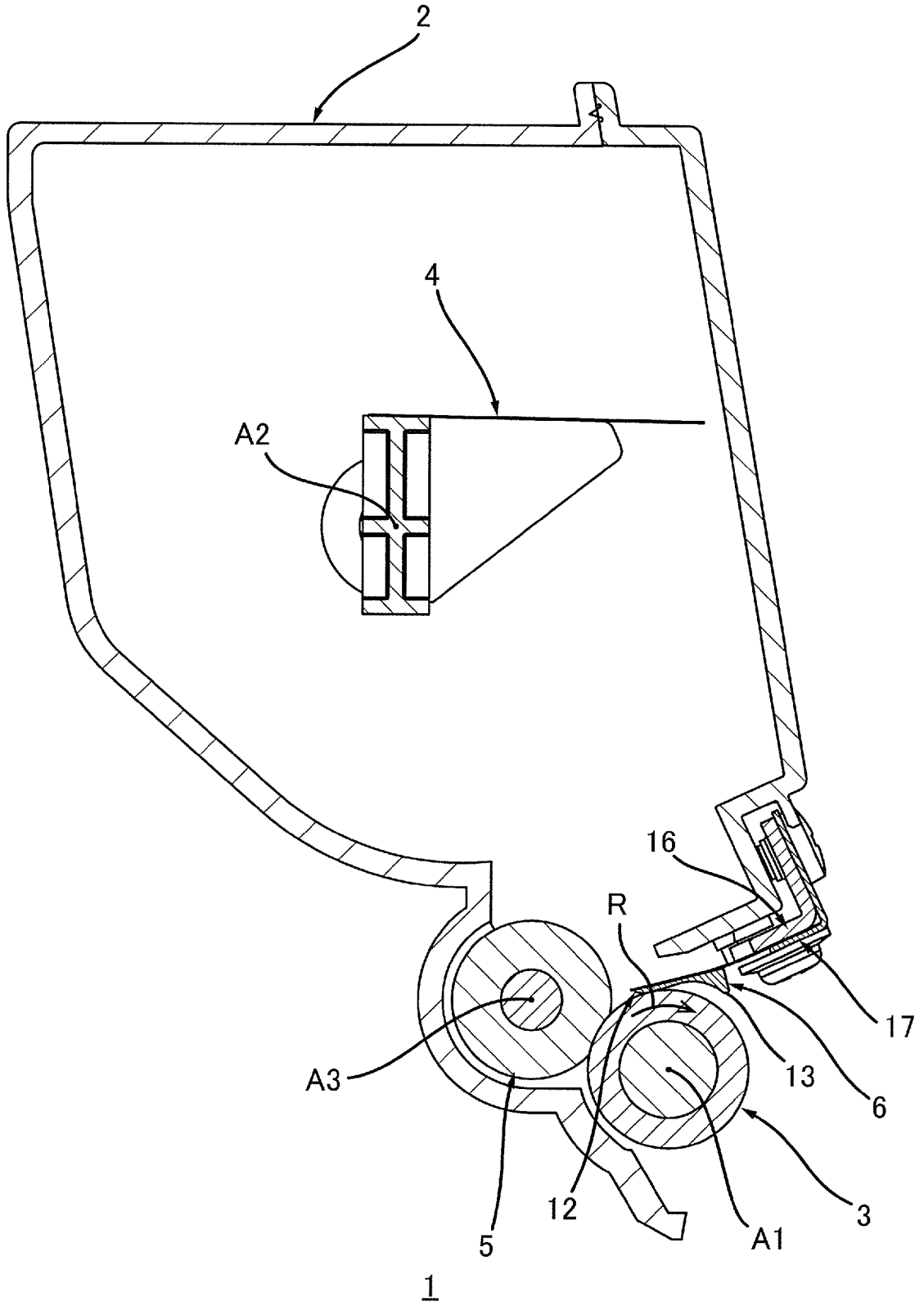
FIG. 1 is a cross-sectional view schematically showing a configuration of a development device in an illustrative embodiment according to one or more aspects of the present disclosure.

According to aspects of the present disclosure, a development device is provided, which includes a housing configured to store toner, a development roller supported by the housing, the development roller being rotatable around an axis extending along an axial direction of the development roller, the development roller being configured to carry the toner from the housing on a circumferential surface of the development roller, and a layer thickness regulating blade supported by the housing. The layer thickness regulating blade includes a support sheet metal having a distal end portion and a base end portion in a width direction of the support sheet metal, the base end portion being attached to the housing, the support sheet metal having a first end portion, a second end portion, and a center portion between the first end portion and the second end portion, in the axial direction, a blade rubber section supported by the center portion of the support sheet metal in the axial direction, the blade rubber section being configured to contact the circumferential surface of the development roller, and a first side edge seal supported by the first end portion of the support sheet metal in the axial direction, the first side edge seal being adjacent to the blade rubber section in the axial direction, the first side end seal being configured to contact the circumferential surface of the development roller, the first side edge seal being pinched and compressed between the support sheet metal and the development roller. In the width direction, the first end portion of the support sheet metal in the axial direction is shorter than the center portion of the support sheet metal in the axial direction, the width direction being a direction from the base end portion of the support sheet metal toward the distal end portion of the support sheet metal. In the width direction, a distal-end edge of the first end portion of the support sheet metal is closer to the base end portion of the support sheet metal than a distal-end edge of the blade rubber section, the distal-end edge of the first end portion of the support sheet metal being an edge closer to the distal end portion of the support sheet metal among two edges of the first end portion in the width direction, the distal-end edge of the blade rubber section being an edge closer to the distal end portion of the support sheet metal among two edges of the blade rubber section in the width direction.

According to aspects of the present disclosure, further provided is a development device including a housing configured to store toner, a development roller supported by the housing, the development roller being rotatable around an axis extending along an axial direction of the development roller, the development roller being configured to carry the toner from the housing on a circumferential surface of the development roller, and a layer thickness regulating blade supported by the housing. The layer thickness regulating blade includes a support sheet metal having a distal end portion and a base end portion in a width direction of the support sheet metal, the base end portion being attached to the housing, the support sheet metal having a slit extending along the axial direction, the slit being formed at an end portion of the support sheet metal in the axial direction, and a blade rubber section supported by the distal end portion of the support sheet metal, the blade rubber section being configured to contact the circumferential surface of the development roller.

According to aspects of the present disclosure, further provided is a development device including a housing configured to store toner, a development roller supported by the housing, the development roller being rotatable around an axis extending along an axial direction of the development roller, the development roller being configured to carry the toner from the housing on a circumferential surface of the development roller, a first attachment sheet metal fixed to the housing, a second attachment sheet metal fixed to the housing, and a layer thickness regulating blade supported by the housing. The layer thickness regulating blade includes a support sheet metal having a distal end portion and a base end portion in a width direction of the support sheet metal, the base end portion being attached to the housing, the support sheet metal having a fixed section configured to be fixed to the housing when pinched between the first attachment sheet metal and the second attachment sheet metal, the fixed section extending along the axial direction, the fixed section having a first end part, a second end part, and a middle part in the axial direction, the second end part being spaced apart from the first end part in the axial direction, the middle part being positioned between the first end part and the second end part in the axial direction, and a blade rubber section supported by the distal end portion of the support sheet metal, the blade rubber section being configured to contact the circumferential surface of the development roller, the blade rubber section being positioned between the first end part and the second end part of the fixed section, in the axial direction. In the width direction, a distance between the first end part of the fixed section and the blade rubber section and a distance between the second end part of the fixed section and the blade rubber section are longer than a distance between the middle part of the fixed section and the blade rubber section, the width direction being a direction from the base end portion of the support sheet metal toward the distal end portion of the support sheet metal.

According to aspects of the present disclosure, further provided is a development device including a housing configured to store toner, a development roller supported by the housing, the development roller being rotatable around an axis extending along an axial direction of the development roller, the development roller being configured to carry the toner from the housing on a circumferential surface of the development roller, a first attachment sheet metal fixed to the housing, a second attachment sheet metal fixed to the housing, and a layer thickness regulating blade supported by the housing. The layer thickness regulating blade includes a support sheet metal having a distal end portion and a base end portion in a width direction of the support sheet metal, the base end portion being attached to the housing, the support sheet metal having a fixed section configured to be fixed to the housing when pinched between the first attachment sheet metal and the second attachment sheet metal, and a blade rubber section supported by the distal end portion of the support sheet metal, the blade rubber section being configured to contact the circumferential surface of the development roller, the blade rubber section having a first end part and a second end part in the axial direction, the second end part being spaced apart from the first end part in the axial direction. The fixed section is positioned between the first end part and the second end part of the blade rubber section, in the axial direction.

It is noted that various connections are set forth between elements in the following description. It is noted that these connections in general and, unless specified otherwise, may be direct or indirect and that this specification is not intended to be limiting in this respect.

Illustrative Embodiment

1. General Description of Development Device

The following provides a general description of a development device 1 in an illustrative embodiment according aspects of the present disclosure.

As shown in FIG. 1, the development device 1 includes a housing 2, a development roller 3, an agitator 4, a supply roller 5, and a layer thickness regulating blade 6.

1. 1. Housing

The housing 2 is configured to store toner. The housing 2 extends along an axial direction of the development roller 3 (see FIG. 2).

1. 2. Development Roller

The development roller 3 is supported by an end portion of the housing 2. The development roller 3 extends along the axial direction. The development roller 3 is formed in a cylindrical shape. The development roller 3 is rotatable around an axis A1 extending along the axial direction. When the toner stored in the housing 2 is supplied onto a circumferential surface of the development roller 3, the development roller 3 carries the supplied toner on the circumferential surface thereof

1. 3. Agitator

The agitator 4 is disposed inside the housing 2. The agitator 4 is configured to agitate the toner in the housing 2. The agitator 4 extends along the axial direction. The agitator 4 is rotatable around an axis A2 extending along the axial direction.

1. 4. Supply Roller

The supply roller 5 is disposed inside the housing 2. The supply roller 5 is configured to supply the toner stored in the housing 2 to the development roller 3. The supply roller 5 is further configured to contact the development roller 3. Nonetheless, the supply roller 5 may not be in contact with the development roller 3. The supply roller 5 extends along the axial direction. The supply roller 5 is formed in a cylindrical shape. The supply roller 5 is rotatable around an axis A3 extending along the axial direction.

1. 5. Layer Thickness Regulating Blade

Figure 2:
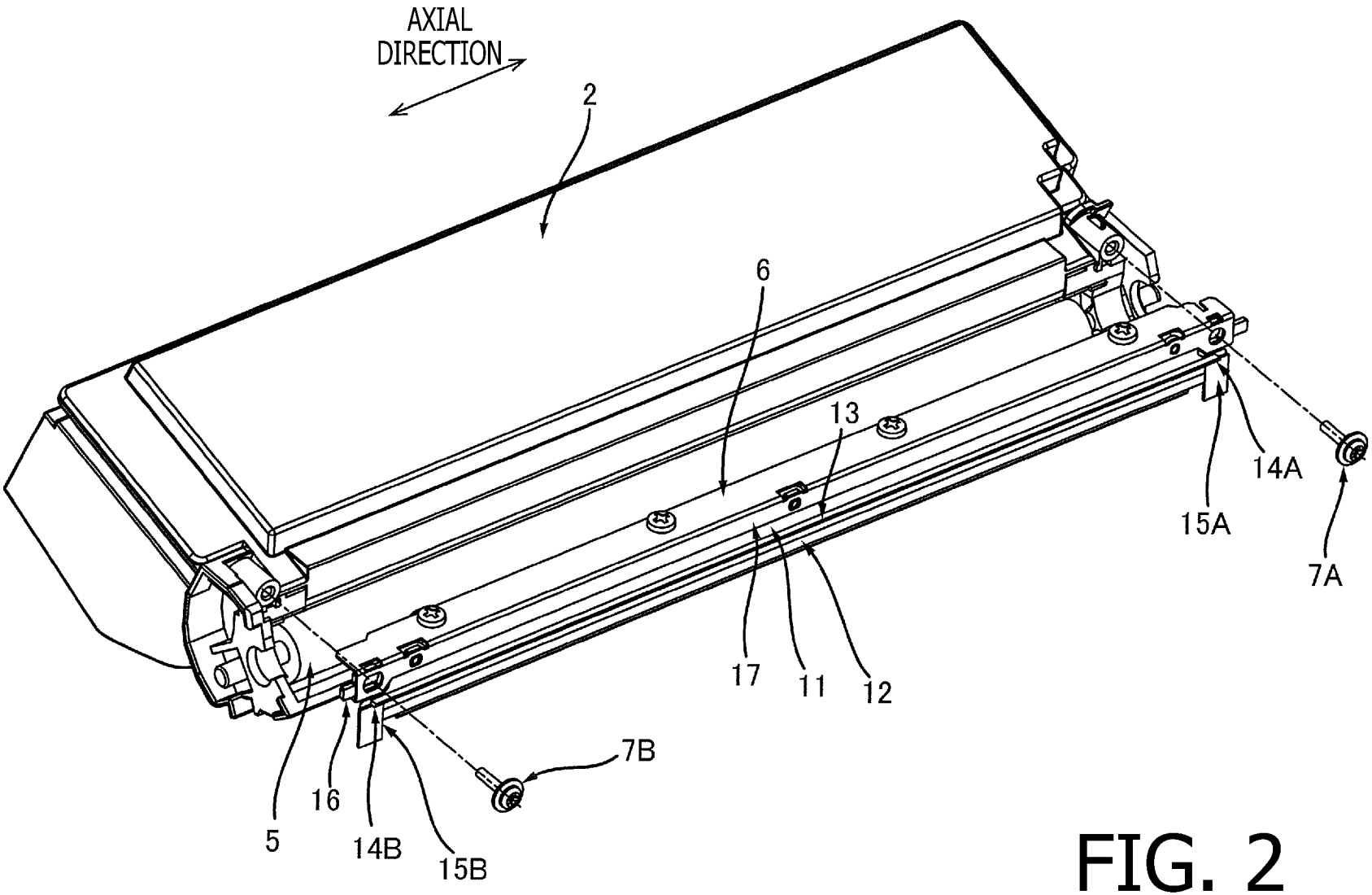
FIG. 2 is an exploded perspective view showing a housing and a layer thickness regulating blade of the development device in the illustrative embodiment according to one or more aspects of the present disclosure.

The layer thickness regulating blade 6 is supported by the housing 2. Specifically, as shown in FIG. 2, the layer thickness regulating blade 6 is attached and fixed to the housing 2 with screws 7A and 7B. The layer thickness regulating blade 6 is configured to regulate a thickness of the tonner supplied from the supply roller 5 and carried on the circumferential surface of the development roller 3. Thereby, the development roller 3 may carry toner of a uniform thickness on the circumferential surface thereof.

2. Details of Layer Thickness Regulating Blade

Subsequently, the layer thickness regulating blade 6 will be described in detail below.

As shown in FIG. 2, the layer thickness regulating blade 6 includes a support sheet metal 11, a blade rubber section 12, a rib 13, positioning ribs 14A and 14B, a first side edge seal 15A, a second side edge seal 15B, a first attachment sheet metal 16, and a second attachment sheet metal 17.

2. 1. Support Sheet Metal

Figure 3:
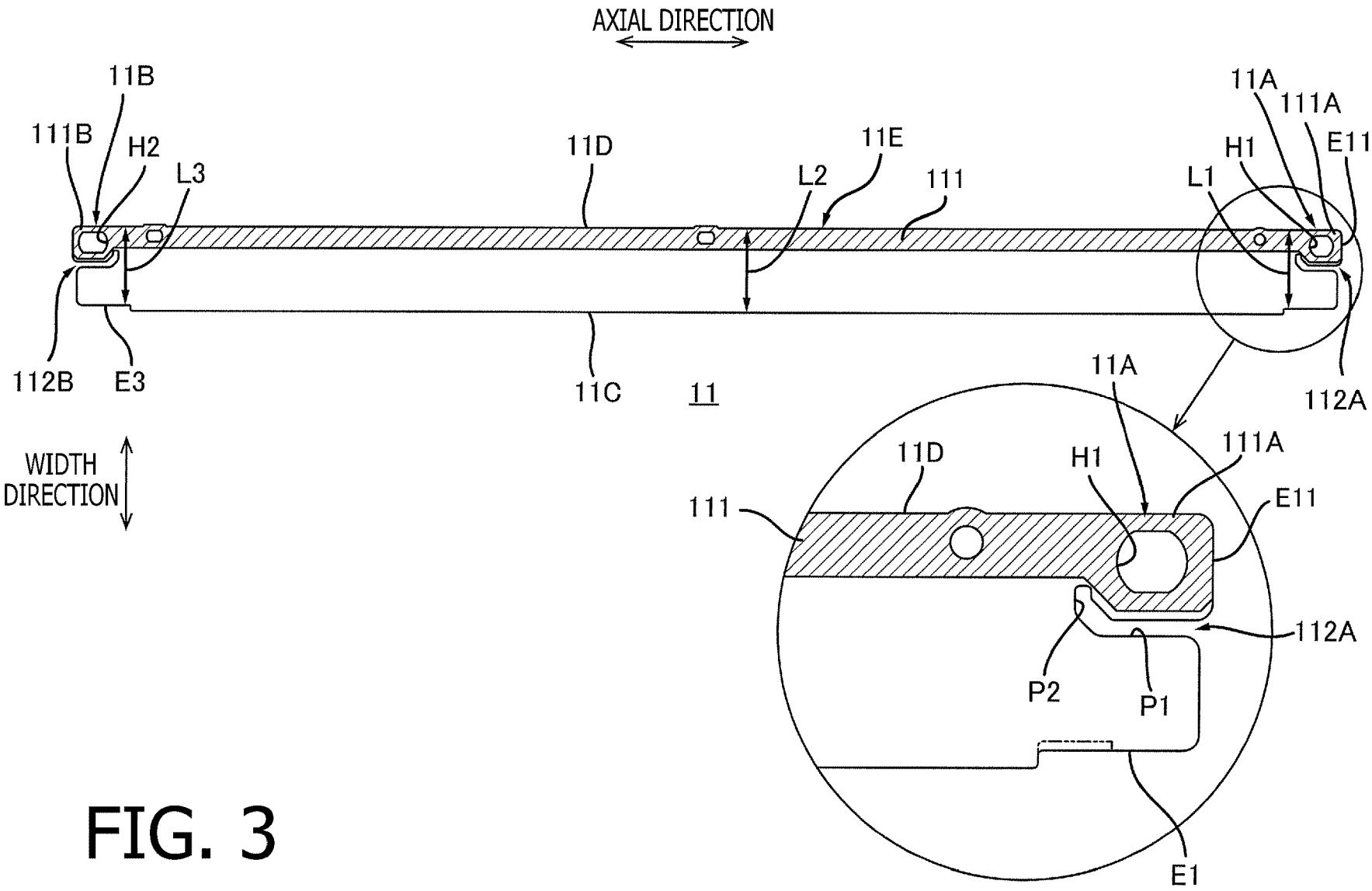
FIG. 3 is a plan view showing a support sheet metal of the layer thickness regulating blade in the illustrative embodiment according to one or more aspects of the present disclosure.

As shown in FIG. 3, the support sheet metal 11 extends along the axial direction. The support sheet metal 11 is formed in a flat plate shape. The support sheet metal 11 has a first end portion 11A and a second end portion 11B in the axial direction. Further, the support sheet metal 11 has a distal end portion 11C and a base end portion 11D in a width direction of the support sheet metal 11. The base end portion 11D is attached to the housing 2. The distal end portion 11C is spaced apart from the base end portion 11D in the width direction. The width direction intersects with the axial direction. More specifically, the width direction is perpendicular to the axial direction.

With respect to dimensions (i.e., widths) of the support sheet metal 11 in the width direction, the first end portion 11A of the support sheet metal 11 is shorter in the width direction than a center portion 11E of the support sheet metal 11 in the axial direction. In other words, a width L1 of the first end portion 11A is shorter than a width L2 of the center portion 11E of the support sheet metal 11 in the axial direction. Further, in the width direction, an edge E1 of the first end portion 11A that is positioned on a side of the distal end portion 11C is closer to the base end portion 11D than an edge E2 of the blade rubber section 12 (see FIG. 5) that is positioned on the side of the distal end portion 11C. Thus, in the width direction, the edge E1 of the first end portion 11A is closer to a contact portion 121 of the blade rubber section 12 than the edge E2 of the blade rubber section 12. Specifically, the edge E1 of the first end portion 11A is positioned within an area A (see FIG. 5) where the blade rubber section 12 contacts the development roller 3, in the width direction. It is noted that, in the width direction, a recess as shown by an imaginary line in an enlarged view of FIG. 3 may be between the edge E1 of the first end portion 11A and the edge E2 of the blade rubber section 12.

The first side edge seal 15A (see FIG. 8) attached to the first end portion 11A is compressed between the edge E1 of the first end portion 11A and the development roller 3. More specifically, in this case, the first side edge seal 15A is compressed by the edge E1 of the first end portion 11A and the development roller 3, near the contact portion 121. Consequently, the first side edge seal 15A is so properly compressed as to ensure a desired contact pressure between the contact portion 121 and the development roller 3 and prevent leakage of toner from a gap between the first end portion 11A and the development roller 3.

Further, a width L3 of the second end portion 11B of the support sheet metal 11 is shorter than the width L2 of the center portion 11E of the support sheet metal 11 in the axial direction. Further, in the width direction, an edge E3 of the second end portion 11B that is positioned on the side of the distal end portion 11C is closer to the base end portion 11D of the support sheet metal 11 than the edge E2 of the blade rubber section 12 (see FIG. 5) that is positioned on the side of the distal end portion 11C. Thereby, in the width direction, the edge E3 of the second end portion 11B is closer to the contact portion 121 of the blade rubber section 12 than the edge E2 of the blade rubber section 12. Specifically, the edge E3 of the second end portion 11B is positioned within the area A (see FIG. 5) where the blade rubber section 12 contacts the development roller 3, in the width direction. In the second end portion 11B as well, in substantially the same manner as the first end portion 11A, the second edge seal 15 B is so properly compressed as to ensure a desired contact pressure between the contact portion 121 and the development roller 3 and prevent leakage of toner from a gap between the second end portion 11B and the development roller 3.

The support sheet metal 11 has a fixed section 111. Further, the support sheet metal 11 has slits 112A and 112B.

2. 1. 1. Fixed Section

The fixed section 111 is shown as a hatched section in FIG. 3. Specifically, the fixed section 111 is a section of the support sheet metal 11 that is pinched between the first attachment sheet metal 16 (see FIG. 1) and the second attachment sheet metal 17 (see FIG. 1). Thus, the fixed section 111 is pinched between the first attachment sheet metal 16 and the second attachment sheet metal 17, thereby being fixed to the housing 2. The fixed section 111 is positioned at the base end portion 11D. Namely, the base end portion 11D is fixed to the housing 2. The fixed section 111 extends along the axial direction. The fixed section 111 has a first end portion 111A and a second end portion 111B in the axial direction. The first end portion 111A of the fixed section 111 is positioned at the first end portion 11A of the support sheet metal 11. The second end portion 111B of the fixed section 111 is positioned at the second end portion 11B of the support sheet metal 11. The second end portion 111B is spaced apart from the first end portion 111A in the axial direction. The fixed section 111 has a hole H1 and a hole H2. The hole H1 is a hole through which a screw 7A (see FIG. 2) is inserted. The hole H2 is a hole through which a screw 7B (see FIG. 2) is inserted. The hole H1 is positioned at the first end portion 111A of the fixed section 111. The hole H2 is positioned at the second end portion 111B of the fixed section 111.

2. 1. 2. Slits

The slit 112A is positioned at the first end portion 11A of the support sheet metal 11 in the axial direction. In the width direction, the slit 112A is positioned between the first end portion 111A of the fixed section 111 in the axial direction and a first end portion 12A of the blade rubber section 12 (see FIG. 5) in the axial direction. The slit 112A is positioned between the hole H1 and the first end portion 12A of the blade rubber section 12, in the width direction. The slit 112A is positioned between the hole H1 and the first side edge seal 15A (see FIG. 8) in the width direction.

The slit 112A extends along the axial direction. The slit 112A extends up to the edge E11 of the support sheet metal 11 in the axial direction. Thereby, the first end portion 11A of the support sheet metal 11 is divided into two parts in the width direction with the slit 112A as a boundary between the two parts. Thus, the first end portion 12A of the blade rubber section 12 (see FIG. 5) in the axial direction is allowed to easily move independently of the fixed section 111. Hence, when the blade rubber section 12 is brought into contact with the circumferential surface of the development roller 3 in a state where the fixed section 111 of the support sheet metal 11 is fixed to the housing 2, the first end portion 12A of the blade rubber section 12 in the axial direction is allowed to easily follow the circumferential surface of the development roller 3. Consequently, it is possible to prevent the first end portion 12A of the blade rubber section 12 in the axial direction from excessively pressing the circumferential surface of the development roller 3.

The slit 112A has a first portion P1 and a second portion P2.

The first portion P1 extends along the axial direction. The first portion P1 extends up to the edge E11 of the support sheet metal 11 in the axial direction. The first portion P1 is positioned between the hole H1 and the first side edge seal 15A (see FIG. 8) in the width direction.

The second portion P2 extends from the first portion P1 toward the fixed section 111. The second portion P2 extends along the width direction.

The slit 112B is positioned at the second end portion 11B of the support sheet metal 11 in the axial direction. In the width direction, the slit 112B is positioned between the second end portion 111B of the fixed section 111 in the axial direction and a second end portion 12B of the blade rubber section 12 (see FIG. 5) in the axial direction. The slit 112A is positioned between the hole H2 and the second end portion 12B of the blade rubber section 12, in the width direction. The slit 112A is positioned between the hole H2 and the second edge seal 15B (see FIG. 8) in the width direction.

It is noted that the slit 112B may be explained substantially in the same manner as the slit 112A. Therefore, the explanation of the slit 112A is applied to the slit 112B, and an explanation of the slit 112B will be omitted.

2. 2. Blade Rubber Section

Figure 4:
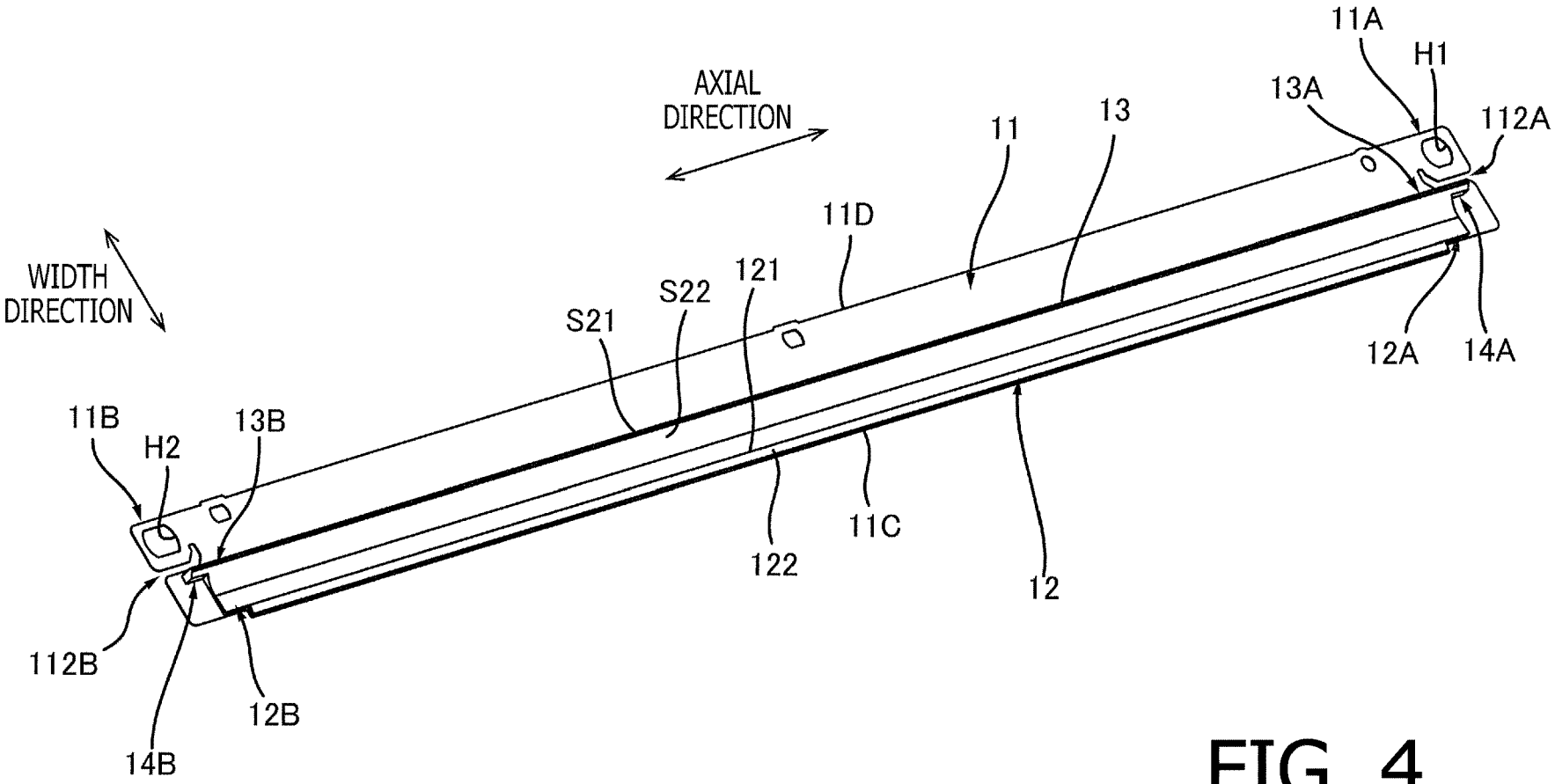
FIG. 4 is a perspective view of the support sheet metal supporting a blade rubber section in the illustrative embodiment according to one or more aspects of the present disclosure.
Figure 5:
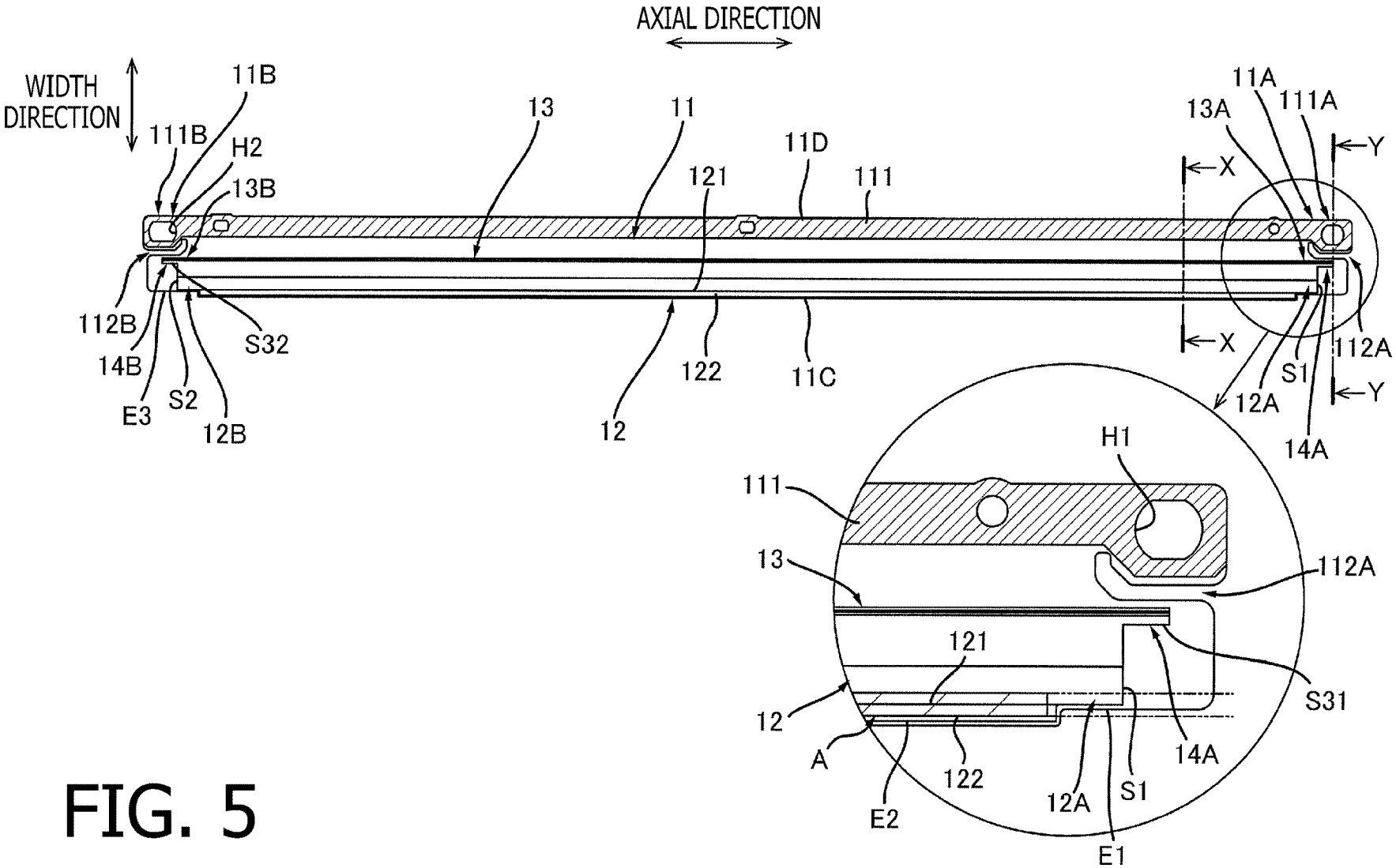
FIG. 5 is a plan view showing the support sheet metal and the blade rubber section in the illustrative embodiment according to one or more aspects of the present disclosure.

As shown in FIGS. 4 and 5, the blade rubber section 12 is supported by the distal end portion 11C of the support sheet metal 11. The blade rubber section 12 is spaced apart from the base end portion 11D of the support sheet metal 11 in the width direction. The blade rubber section 12 is configured to contact the support sheet metal 11. The blade rubber section 12 is disposed on a surface of the support sheet metal 11. The blade rubber section 12 is supported by the center portion 11E of the support sheet metal 11 in the axial direction. The blade rubber section 12 is positioned between the first end portion 11A and the second end portion 11B of the support sheet metal 11 in the axial direction. The blade rubber section 12 is positioned between the first end portion 111A and the second end portion 111B of the fixed section 111 in the axial direction. The blade rubber section 12 extends along the axial direction. The blade rubber section 12 has the first end portion 12A and the second end portion 12B in the axial direction. The second end portion 12B is spaced apart from the first end portion 12A in the axial direction. The blade rubber section 12 is configured to contact the circumferential surface of the development roller 3. Specifically, the blade rubber section 12 has the contact portion 121 and an extension 122. Further, the blade rubber section 12 has axial direction positioning surfaces S1 and S2.

2. 2. 1. Contact Portion

Figure 6:
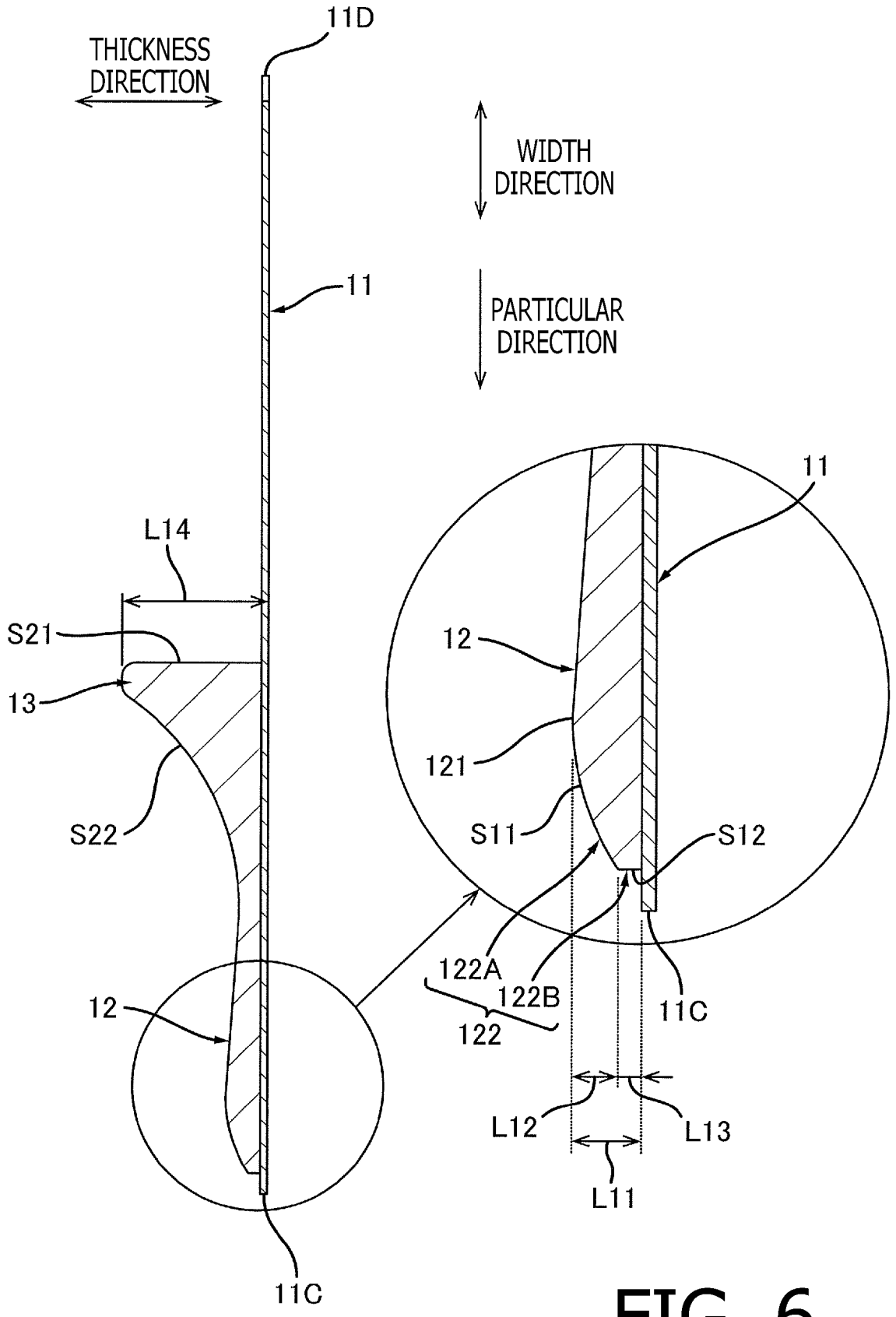
FIG. 6 is a cross-sectional view taken along a line X-X in FIG. 5, in the illustrative embodiment according to one or more aspects of the present disclosure.

The contact portion 121 is a part of the blade rubber section 12, and is configured to contact the circumferential surface of the development roller 3 (see FIG. 1). As shown in FIG. 6, the contact portion 121 is a highest part of the blade rubber section 12 in a thickness direction of the support sheet metal 11. The contact portion 121 is spaced apart from the base end portion 11D of the support sheet metal 11 in the width direction. The contact portion 121 extends along the axial direction.

Specifically, a height (i.e., a length) L11 of the contact portion 121 of the blade rubber section 12 in the thickness direction is equal to or more than 0.4 mm and equal to or less than 1.50 mm. Preferably, the height L11 of the contact portion 121 of the blade rubber section 12 in the thickness direction may be equal to or more than 0.45 mm and equal to or less than 0.55 mm.

2. 2. 2. Extension

The extension 122 is opposed to the base end portion 11D of the support sheet metal 11 across the contact portion 121 in the width direction. The extension 122 extends from the contact portion 121 in a particular direction. The particular direction is a direction, along the width direction, from the base end portion 11D of the support sheet metal 11 toward the distal end portion 11C of the support sheet metal 11. In other words, the particular direction is a direction from the base end portion 11D of the support sheet metal 11 toward the blade rubber section 12. The extension 122 includes a curved surface portion 122A and an end face portion 122B. The curved surface portion 122A has a curved surface S11. The end face portion 122B has an end face S12. Namely, the extension 122 has the end face S12.

2. 2. 2. 1. Curved Surface Portion

The curved surface S11 extends from the contact portion 121 in the particular direction. The curved surface S11 is formed to be closer to the support sheet metal 11 in the thickness direction as being farther away from the contact portion 121 in the particular direction. A curvature radius of the curved surface S11 is equal to or more than 1.5 mm and equal to or less than 3.0 mm. Preferably, the curvature radius of the curved surface 11 may be equal to or more than 1.9 mm and equal to or less than 2.1 mm.

Since the curvature radius of the curved surface 11 is equal to or more than the above lower limit (e.g., 1.5 mm) and equal to or less than the above upper limit (e.g., 3.0 mm), the toner carried on the circumferential surface of the development roller 3 is smoothly guided to the contact portion 121.

A height L12 of the curved surface portion 122A in the thickness direction is equal to or less than 1.0 mm. Preferably, the height L12 of the curved surface portion 122A in the thickness direction may be equal to or more than 0.17 mm. Namely, it is preferred that the height L12 of the curved surface portion 122A in the thickness direction is equal to or more than 0.17 mm and equal to or less than 1.0 mm.

Preferably, the height L12 of the curved surface portion 122A in the thickness direction may be equal to or less than 0.5 mm. Namely, more preferably, the height L12 of the curved surface portion 122A in the thickness direction may be equal to or more than 0.17 mm and equal to or less than 0.5 mm.

Since the height L12 of the curved surface portion 122A in the thickness direction is equal to or less than the above upper limit (e.g., 1.0 mm), it is possible to make the blade rubber section 12 thinner. Since the height L12 of the curved surface portion 122A in the thickness direction is equal to or more than the above lower limit (e.g., 0.17 mm), it is possible to easily form the curved surface portion 122A.

2. 2. 2. 2. End Face Portion

The end face S12 is spaced apart from the contact portion 121 in the particular direction. The end face S12 is positioned between the curved surface S11 and the support sheet metal 11 in the thickness direction. The end face S12 extends along the thickness direction. The end face S12 is connected with the curved surface S11 and the surface of the support sheet metal.

A height L13 of the end face portion 122B is equal to or more than 0.05 mm. Preferably, the height L13 of the end face portion 122B may be equal to or less than 1.00 mm. Namely, it is preferred that the height L13 of the end face portion 122B is equal to or more than 0.05 mm and equal to or less than 1.00 mm. More preferably, the height L13 of the end face portion 122B may be equal to or more than 0.05 mm and equal to or less than 0.35 mm.

Since the blade rubber section 12 has the curved surface portion 122A and the end face portion 122B, it is possible to downsize the blade rubber section 12 in the width direction. Further, since the height L13 of the end face portion 122B in the thickness direction is equal to or more than the above lower limit (e.g., 0.05 mm), it is possible to easily form the blade rubber section 12.

2. 2. 3. Axial Direction Positioning Surfaces

As shown in FIG. 5, the axial direction positioning surface S1 is positioned at the first end portion 12A of the blade rubber section 12 in the axial direction. The axial direction positioning surface S1 is one of both end faces of the blade rubber section 12 in the axial direction. The axial direction positioning surface S1 extends along the width direction. The axial direction positioning surface S1 is configured to position the first side edge seal 15A (see FIG. 8) in the axial direction.

The axial direction positioning surface S2 is positioned at the second end portion 12B of the blade rubber section 12 in the axial direction. The axial direction positioning surface S2 is the other of both the end faces of the blade rubber section 12 in the axial direction. The axial direction positioning surface S2 extends along the width direction. The axial direction positioning surface S2 is configured to position the second side edge seal 15B (see FIG. 8) in the axial direction.

2. 3. Rib

As shown in FIGS. 4 and 6, the rib 13 is positioned between the base end portion 11D of the support sheet metal 11 and the blade rubber section 12 in the width direction. In other words, the lib 13 is positioned between the base end portion 11D of the support sheet metal 11 and the contact portion 121 in the width direction. The rib 13 is positioned on the surface of the support sheet metal 11. The rib 13 is connected with the blade rubber section 12. The rib 13 and the blade rubber section 12 are made of the same material. Specifically, for instance, the rib 13 and the blade rubber section 12 may be made of thermosetting elastomer. More specifically, the rib 13 and the blade rubber section 12 may be made of silicon rubber. The rib 13 is formed integrated with the blade rubber section 12, on the surface of the support sheet metal 11. Nonetheless, the rib 13 and the blade rubber section 12 may be made of respective different materials. Further, the rib 13 may be spaced apart from the blade rubber section 12.

The rib 13 extends along the axial direction. As shown in FIG. 4, the rib 13 is as long as the blade rubber section 12 in the axial direction. The rib 13 has a first end portion 13A and a second end portion 13B in the axial direction. The first end portion 13A is in the same position as the first end portion 12A of the blade rubber section 12, in the axial direction. The second end portion 13B is spaced apart from the first end portion 13A in the axial direction. The second end portion 13B is in the same position as the second end portion 12B of the blade rubber section 12, in the axial direction.

As shown in FIG. 6, the rib 13 protrudes from the support sheet metal 11 in the thickness direction. A height L14 by which the rib 13 protrudes from the support sheet metal 11 in the thickness direction is more than a height L11 by which the blade rubber section 12 protrudes from the support sheet metal 11 in the thickness direction.

Thereby, as shown in FIG. 1, the rib 13, higher than the blade rubber section 12, is positioned downstream of the blade rubber section 12 in a rotational direction R of the development roller 3 in a contact region where the blade rubber section 12 contacts the development roller 3. Hence, even when toner is scattered from the contact region between the blade rubber section 12 and the development roller 3, the rib 13 catches the scattered toner. Consequently, it is possible to prevent surrounding elements from being stained or contaminated with the scattered toner.

As shown in FIGS. 4 and 6, the rib 13 has a first surface S21 and a second surface S22 in the width direction. The second surface S22 is positioned between the first surface S21 and the blade rubber section 12 in the width direction. The second surface S22 is a curved surface. The second surface S22 is formed to be farther away from the support sheet metal 11 in the thickness direction as being farther away from the blade rubber section 12 in the width direction.

2. 4. Positioning Ribs

As shown in FIGS. 4 and 5, the positioning rib 14A is opposed to the second end portion 13B of the rib 13 across the first end portion 13A of the rib 13 in the axial direction. The positioning rib 14A is adjacent to the first end portion 13A of the rib 13 in the axial direction. The positioning rib 14A is connected with the first end portion 13A of the rib 13. Nonetheless, the positioning rib 14A may be spaced apart from the rib 13. The positioning rib 14A is made of the same material as the material of the blade rubber section 12 and the rib 13. Nonetheless, the positioning rib 14A may be made of a different material from the material of the blade rubber section 12 and the rib 13.

As shown in FIG. 5, the positioning rib 14A extends along the axial direction. The positioning rib 14A has a width direction positioning surface S31. The width direction positioning surface S31 extends along the axial direction. The width direction positioning surface S31 is configured to position the first side edge seal 15A (see FIG. 8) in the width direction.

Figure 7:
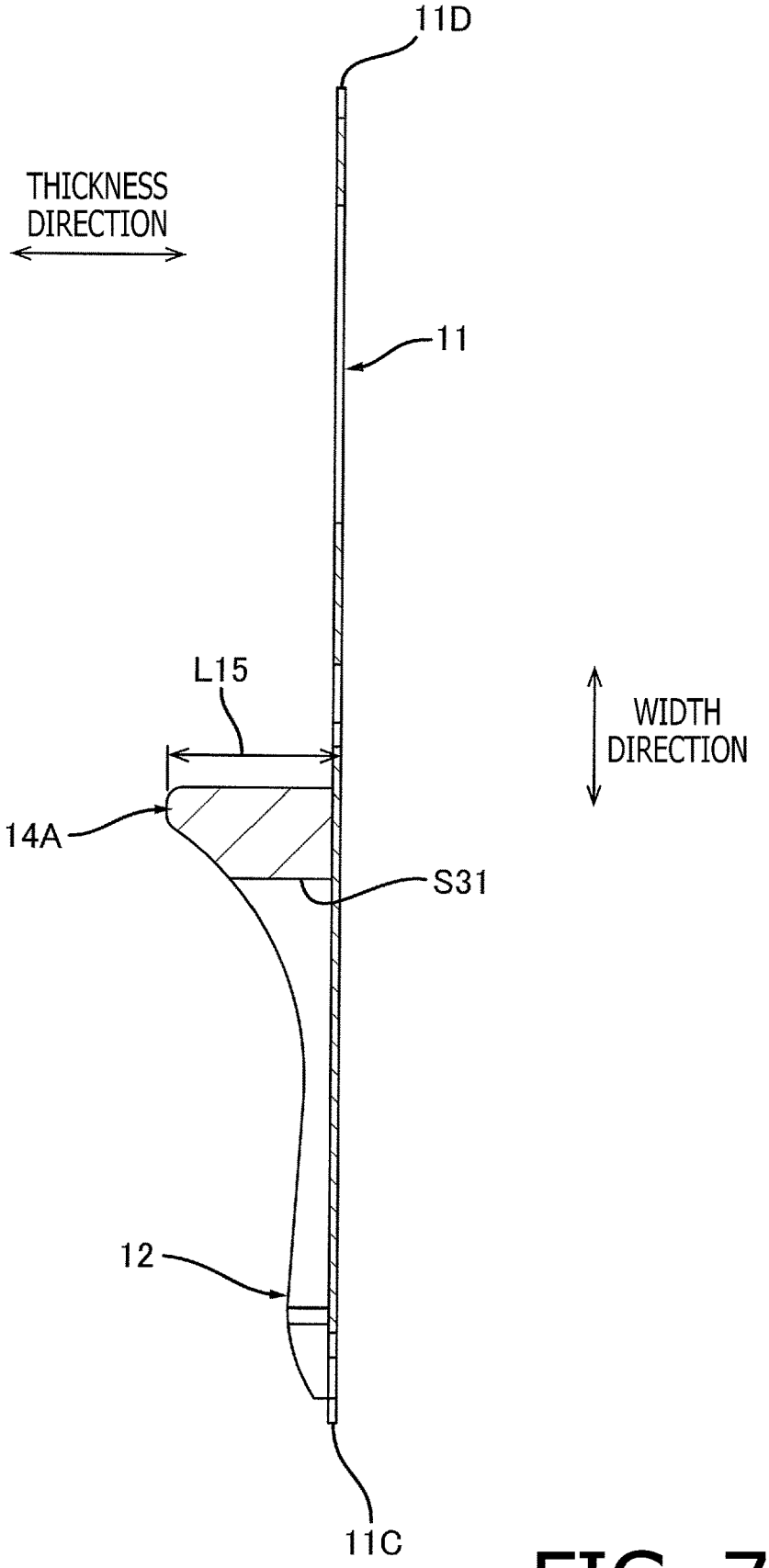
FIG. 7 is a cross-sectional view taken along a line Y-Y in FIG. 5, in the illustrative embodiment according to one or more aspects of the present disclosure.

Further, as shown in FIG. 7, the positioning rib 14A protrudes more than the blade rubber section 12, from the support sheet metal 11 in the thickness direction. In other words, a height L15 by which the positioning rib 14A protrudes from the support sheet metal 11 in the thickness direction is more than the height L11 (see FIG. 6) by which the blade rubber section 12 protrudes from the support sheet metal 11 in the thickness direction. The positioning rib 14A is formed to protrude more from the support sheet metal 11 in the thickness direction as being farther away from the blade rubber section 12 in the width direction.

As shown in FIGS. 4 and 5, the positioning rib 14B is spaced apart from the positioning rib 14A in the axial direction. The positioning rib 14B is opposed to the first end portion 13A of the rib 13 across the second end portion 13B of the rib 13 in the axial direction. Namely, the rib 13 is positioned between the positioning ribs 14A and 14B in the axial direction. The positioning rib 14B is adjacent to the second end portion 13B of the rib 13 in the axial direction. The positioning rib 14B is connected with the second end portion 13B of the rib 13.

The positioning rib 14B has a width direction positioning surface S32. The width direction positioning surface S32 extends along the axial direction. The width direction positioning surface S32 is configured to position the second side edge seal 15B (see FIG. 8) in the width direction.

It is noted that the positioning rib 14B may be explained substantially in the same manner as the positioning rib 14A. Hence, since the explanation of the positioning rib 14A may be applied to the positioning rib 14B, an explanation of the positioning rib 14B will be omitted.

2. 5. First Side Edge Seal

Figure 8:
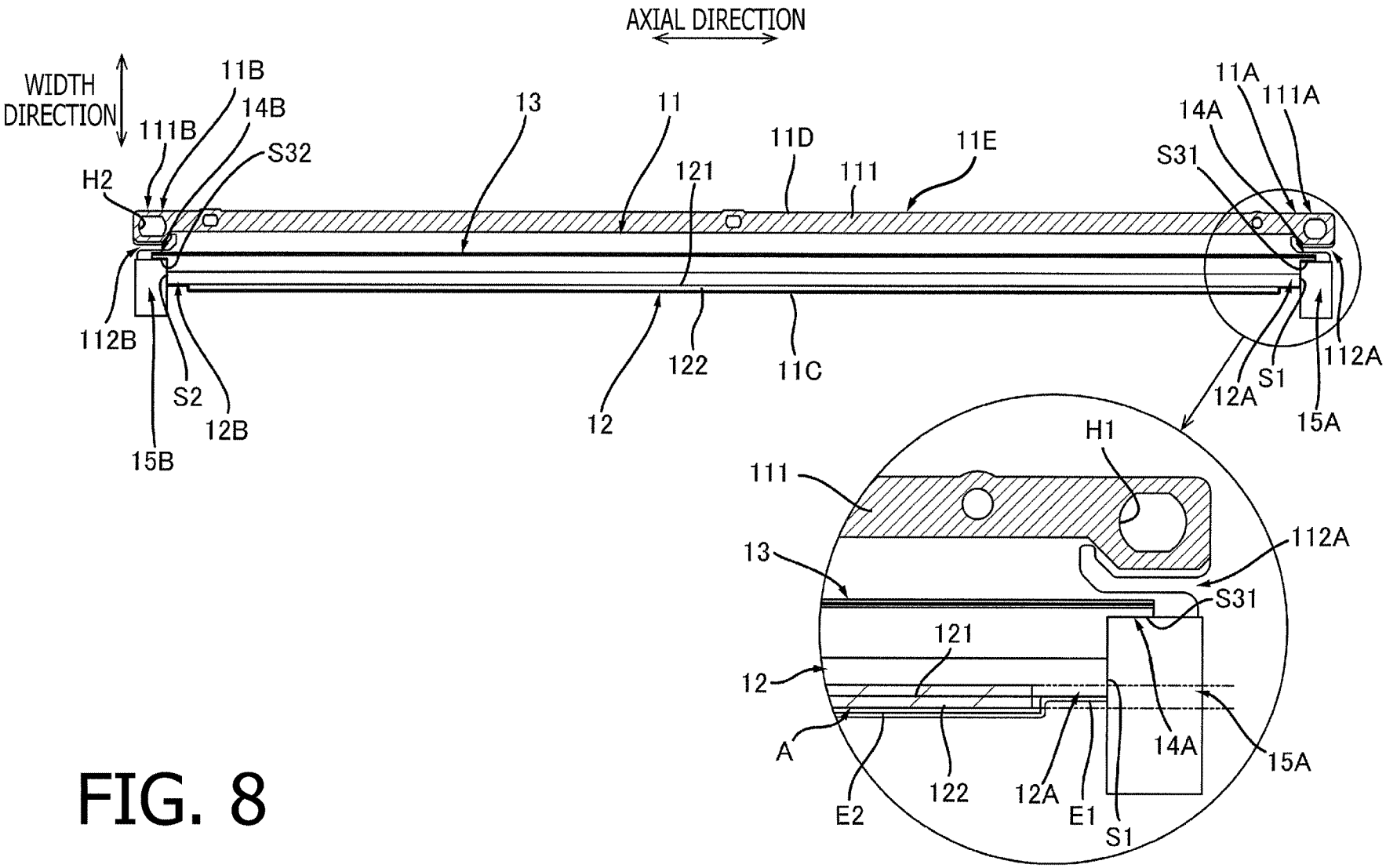
FIG. 8 is a plan view showing the support sheet metal supporting the blade rubber section, a first side edge seal, and a second side edge seal, in the illustrative embodiment according to one or more aspects of the present disclosure.

As shown in FIG. 8, the first side edge seal 15A is supported by the first end portion 11A of the support sheet metal 11. The first side edge seal 15A is adjacent to the blade rubber section 12 in the axial direction. An end of the first side edge seal 15A in the axial direction contacts the axial direction positioning surface S1. An end of the first side edge seal 15A in the width direction contacts the width direction positioning surface S31. Since the end of the first side edge seal 15A in the axial direction contacts the axial direction positioning surface S1 of the blade rubber section 12, the first side edge seal 15A is positioned in the axial direction. Further, since the end of the first side edge seal 15A in the width direction contacts the width direction positioning surface S31 of the positioning rib 14A, the first side edge seal 15A is positioned in the width direction.

Figure 9:
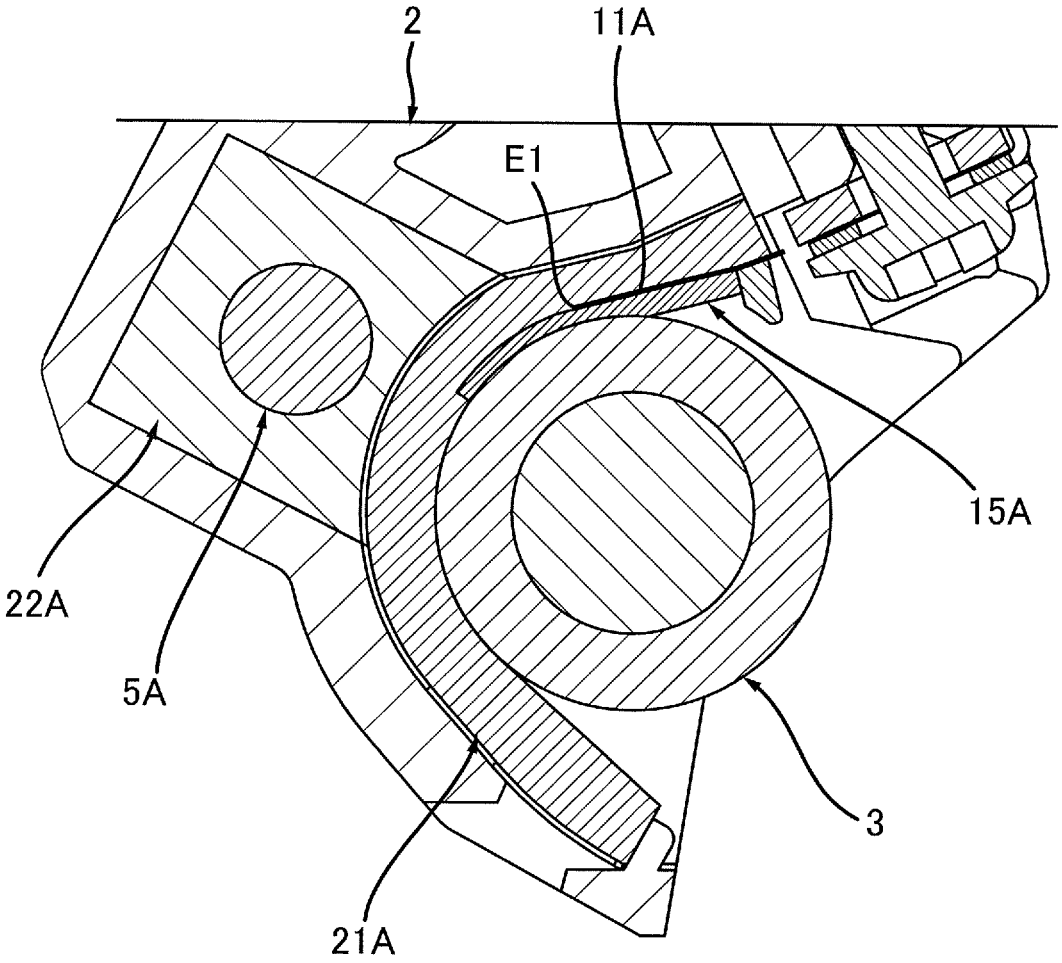
FIG. 9 is a cross-sectional view showing one of two side seals and one of two supply roller seals, in the illustrative embodiment according to one or more aspects of the present disclosure.

As shown in FIG. 9, the first side edge seal 15A is configured to contact the circumferential surface of the development roller 3. More specifically, the first side edge seal 15A is configured to contact a circumferential surface of a first end portion of the development roller 3 in the axial direction. The first side edge seal 15A is made of non-woven fabric. The first side edge seal 15A is pinched and compressed between the support sheet metal 11 and the first end portion of the development roller 3 in the axial direction. Thus, the first side edge seal 15A seals a gap between the support sheet metal 11 and the first end portion of the development roller 3 in the axial direction.

The first side edge seal 15A in an uncompressed state is 1.0 through 1.3 times as thick as the first side edge seal 15A in a compressed state.

When the first side edge seal 15A is compressed at a compression rate satisfying the above condition, the first side edge seal 15A is so properly compressed as to ensure a desired contact pressure between the contact portion 121 and the development roller 3 and prevent leakage of toner from a gap between the first end portion 11A and the development roller 3.

As shown in FIG. 9, the development device 1 further includes side seals 21A and 21B, and supply roller seals 22A and 22B. It is noted that the side seal 21B or the supply roller seal 22B is not shown in any drawing.

The side seal 21A is configured to seal a gap between the first end portion of the development roller 3 in the axial direction and the housing 2 and a gap between the first end portion 11A of the support sheet metal 11 and the housing 2. The side seal 21B (not shown) has substantially the same shape as the side seal 21A, and is configured to seal a gap between a second end portion of the development roller 3 in the axial direction and the housing 2 and a gap between the second end portion 11B of the support sheet metal 11 and the housing 2.

The supply roller seal 22A is configured to seal a surrounding area of a first end portion of the supply roller 5 in an axial direction of the shaft 5A. The supply roller seal 22A contacts the side seal 21A. The supply roller seal 22B (not shown) is configured to seal a surrounding area of a second end portion of the supply roller 5 in the axial direction of the shaft 5A. The supply roller seal 22B contacts the side seal 21B.

2. 6. Second Side Edge Seal

As shown in FIG. 8, the second side edge seal 15B is supported by the second end portion 11B of the support sheet metal 11. The second side edge seal 15B is adjacent to the blade rubber section 12 in the axial direction. The second side edge seal 15B is configured such that an end portion thereof in the axial direction contacts the axial direction positioning surface S2 of the blade rubber section 12. The second side edge seal 15B is further configured such that an end portion thereof in the width direction contacts the width direction positioning surface 32 of the positioning rib 14B. Since the end portion of the second side edge seal 15B in the axial direction contacts the axial direction positioning surface S2 of the blade rubber section 12, the second side edge seal 15B is positioned in the axial direction. Further, since the end portion of the second side edge seal 15B in the width direction contacts the width direction positioning surface S32 of the positioning rib 14B, the second side edge seal 15B is positioned in the width direction.

The second side edge seal 15B is configured to contact the circumferential surface of the development roller 3, substantially in the same manner as the first side edge seal 15A. More specifically, the second side edge seal 15B is configured to contact a circumferential surface of the second end portion of the development roller 3 in the axial direction. The second side edge seal 15B is made of non-woven fabric. The second side edge seal 15B is pinched and compressed between the support sheet metal 11 and the second end portion of the development roller 3 in the axial direction. Thus, the second side edge seal 15B seals a gap between the support sheet metal 11 and the second end portion of the development roller 3 in the axial direction.

The second side edge seal 15B in an uncompressed state is 1.0 through 1.3 times as thick as the second side edge seal 15B in a compressed state. Hence, it is possible to ensure a desired contact pressure between the contact portion 121 and the development roller 3 and prevent leakage of toner from a gap between the second end portion 11B and the development roller 3.

2. 7. First Attachment Sheet Metal and Second Attachment Sheet Metal

As shown in FIGS. 1 and 2, the first attachment sheet metal 16 and the second attachment sheet metal 17 are for attaching the layer thickness regulating blade 6 to the housing 2. The first attachment sheet metal 16 and the second attachment sheet metal 17 are configured to pinch the base end portion 11D of the support sheet metal 11 therebetween. More specifically, the first attachment sheet metal 16 and the second attachment sheet metal 17 are configured to pinch the fixed section 111 of the support sheet metal 11 therebetween. The first attachment sheet metal 16 and the second attachment sheet metal 17 with the base end portion 11D of the support sheet metal 11 pinched therebetween are fixed to the housing 2 with the screws 7A and 7B.

3. Operations and Advantageous Effects

In the development device 1 of the illustrative embodiment, as shown in FIG. 3, the width L1 of the first end portion 11A of the support sheet metal 11 is shorter than the width L2 of the center portion 11E of the support sheet metal 11 in the axial direction. Further, the width L3 of the second end portion 11B of the support sheet metal 11 is shorter than the width L2 of the center portion 11E of the support sheet metal 11 in the axial direction.

As shown in FIG. 5, in the width direction, the edge E1 of the first end portion 11A that is positioned on the side of the distal end portion 11C is closer to the base end portion 11D than the edge E2 of the blade rubber section 12 that is positioned on the side of the distal end portion 11C.

Further, in the width direction, the edge E3 of the second end portion 11B that is positioned on the side of the distal end portion 11C is closer to the base end portion 11D than the edge E2 of the blade rubber section 12 that is positioned on the side of the distal end portion 11C.

Therefore, as shown in FIG. 8, the side edge seal 15A and the second side edge seal 15B are compressed between the support sheet metal 11 and the development roller 3 (see FIG. 9), in a position closer to the base end portion 11D in the width direction than the edge E2 of the blade rubber section 12 that is positioned on the side of the distal end portion 11C.

More specifically, the side edge seal 15A and the second side edge seal 15B are compressed between the support sheet metal 11 and the development roller 3, within the area A where the blade rubber section 12 contacts the development roller 3, in the width direction.

Thereby, it is possible to moderately and appropriately compress the first side edge seal 15A and the second side edge seal 15B and to ensure a desired contact pressure between the blade rubber section 12 and the development roller 3.

Consequently, it is possible to prevent leakage of toner from the gap between the blade rubber section 12 and the development roller 3.

In the development device 1 of the illustrative embodiment, as shown in FIG. 5, the slit 112A is formed at the first end portion 11A of the support sheet metal 11. Further, the slit 112B is formed at the second end portion 11B of the support sheet metal 11. Thereby, it is possible to achieve improved flexibilities of the first end portion 11A and the second end portion 11B of the support sheet metal 11.

Hence, when the blade rubber section 12 is brought into contact with the circumferential surface of the development roller 3 in the state where the support sheet metal 11 is attached to the housing 2, the first end portion 11A of the support sheet metal 11 is bent. Thereby, the first end portion 12A of the blade rubber section 12 in the axial direction is allowed to easily follow the circumferential surface of the development roller 3. In addition, since the second end portion 11B of the support sheet metal 11 is bent, the second end portion 12B of the blade rubber section 12 in the axial direction is allowed to easily follow the circumferential surface of the development roller 3.

Consequently, it is possible to prevent the blade rubber section 12 from excessively pressing the circumferential surface of the development roller 3.

Further, in the development device 1 of the illustrative embodiment, as shown in FIG. 5, the slit 112A extends up to the edge E11 of the support sheet metal 11 in the axial direction.

Therefore, the first end portion 11A of the support sheet metal 11 in the axial direction is divided into two parts with the slit 112A as a boundary between the two parts. In addition, the second end portion 11B of the support sheet metal 11 in the axial direction is divided into two parts with the slit 112B as a boundary between the two parts.

Thereby, the first end portion 12A and the second end portion 12B of the blade rubber section 12 in the axial direction are configured to easily move independently of the base end portion 11D attached to the housing 2.

Hence, when the blade rubber section 12 is brought into contact with the circumferential surface of the development roller 3 in the state where the support sheet metal 11 is attached to the housing 2, the blade rubber section 12 is allowed to more easily follow the circumferential surface of the development roller 3.

Consequently, it is possible to further prevent the blade rubber section 12 from excessively pressing the circumferential surface of the development roller 3.

Hereinabove, the illustrative embodiment according to aspects of the present disclosure has been described. Aspects of the present disclosure may be practiced by employing conventional materials, methodology and equipment. Accordingly, such materials, equipment and methodology are not set forth herein in detail. In the previous descriptions, numerous specific details are set forth, such as specific materials, structures, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein. For instance, the following modifications according to aspects of the present disclosure are feasible.

(Modifications)

Figure 10A:
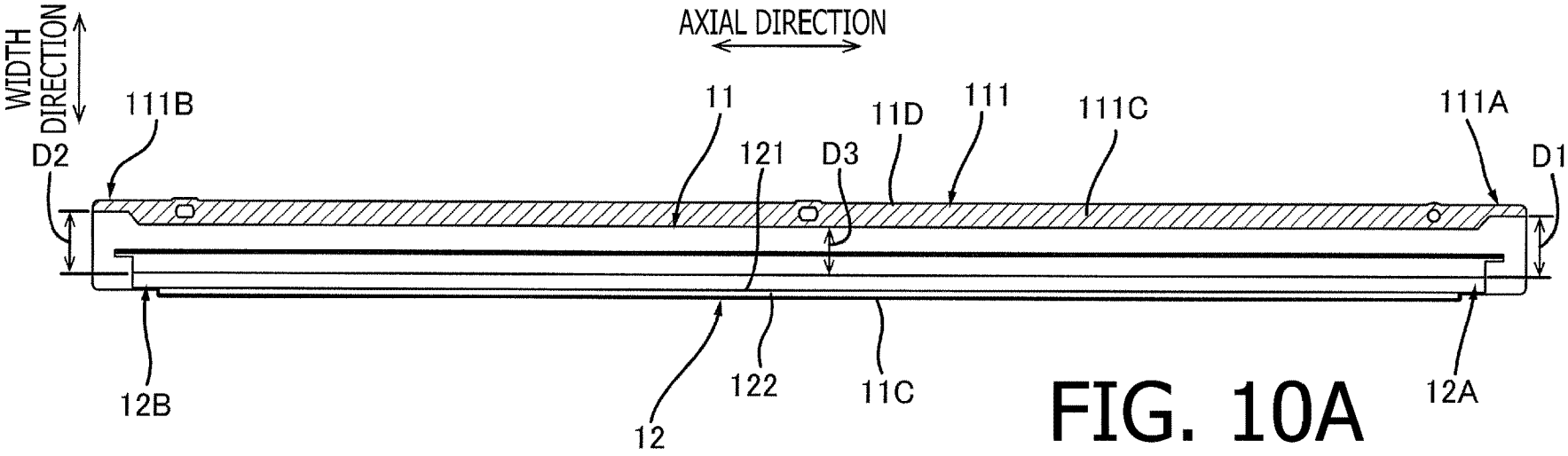
FIG. 10A is a plan view showing a support sheet metal and a blade rubber section in a modification according to one or more aspects of the present disclosure.

As shown in FIG. 10A, the support sheet metal 11 may not have the slit 112A or the slit 112B. In this case, a distance D1 in the width direction between the first end portion 111A of the fixed section 111 and the blade rubber section 12 is longer than a distance D3 in the width direction between a middle portion 111C of the fixed section 111 and the blade rubber section 12. Further, a distance D2 in the width direction between the second end portion 111B of the fixed section 111 and the blade rubber section 12 is longer than the distance D3 in the width direction between the middle portion 111C of the fixed section 111 and the blade rubber section 12. It is noted that the middle portion 111C is a portion, of the fixed section 111, positioned between the first end portion 111A and the second end portion 111B in the axial direction.

In this modification as well, it is possible to prevent the first end portion 12A and the second end portion 12B of the blade rubber section 12 in the axial direction from excessively pressing the circumferential surface of the development roller 3, substantially in the same manner as in the aforementioned illustrative embodiment.

Figure 10B:
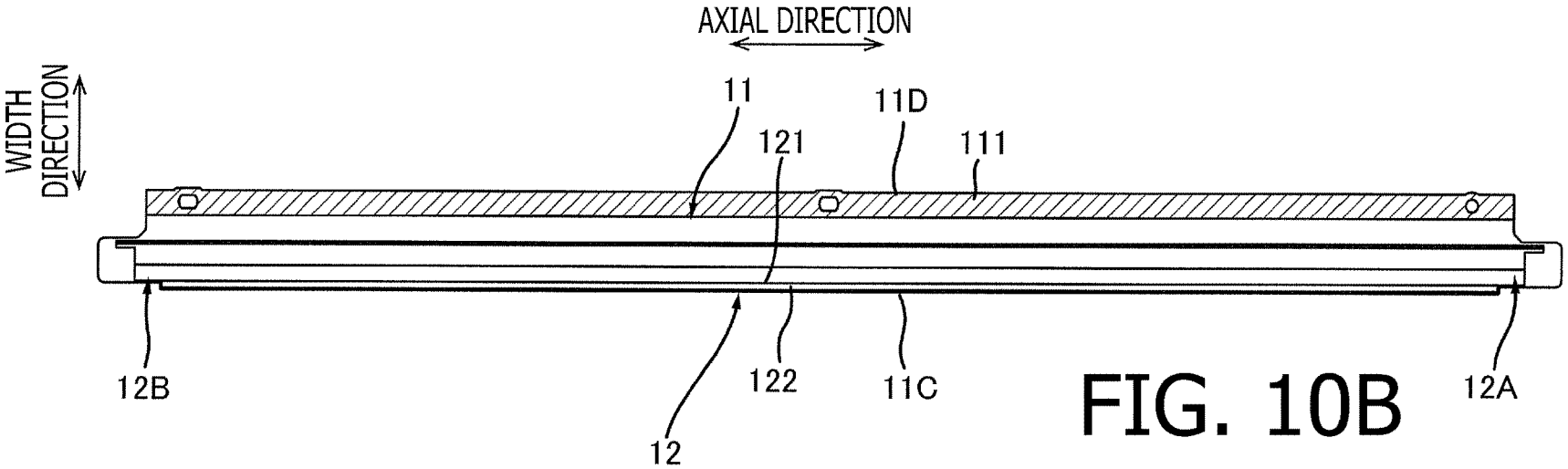
FIG. 10B is a plan view showing a support sheet metal and a blade rubber section in another modification according to one or more aspects of the present disclosure.

Further, as shown in FIG. 10B, the fixed section 111 may be shorter than the blade rubber section 12 in the axial direction. Namely, the fixed section 111 may be positioned between the first end portion 12A and the second end portion 12B of the blade rubber section 12 in the axial direction.

In this modification as well, it is possible to prevent the first end portion 12A and the second end portion 12B of the blade rubber section 12 in the axial direction from excessively pressing the circumferential surface of the development roller 3, substantially in the same manner as in the aforementioned illustrative embodiment.

The development device 1 may be a development cartridge attachable to an image forming apparatus. The development device 1 may not be detachable from an image forming apparatus. The development device 1 may be included in a process cartridge having a photoconductive drum.

What is claimed is:

1. A development device comprising:

a housing configured to store toner;

a development roller supported by the housing, the development roller being rotatable around an axis extending along an axial direction of the development roller, the development roller being configured to carry the toner from the housing on a circumferential surface of the development roller; and a layer thickness regulating blade supported by the housing, the layer thickness regulating blade comprising:

a support sheet metal having a distal end portion and a base end portion in a width direction of the support sheet metal, the base end portion being attached to the housing, the support sheet metal having a first end portion, a second end portion, and a center portion between the first end portion and the second end portion, in the axial direction, wherein the support sheet metal has a slit extending along the axial direction, the slit extending from the first end portion of the support sheet metal towards the center portion of the support sheet metal in the axial direction for an extending range;

a blade rubber section supported by the center portion of the support sheet metal in the axial direction, the blade rubber section being configured to contact the circumferential surface of the development roller; and a first side edge seal supported by the first end portion of the support sheet metal in the axial direction, the first side edge seal being adjacent to the blade rubber section in the axial direction, the first side end seal being configured to contact the circumferential surface of the development roller, the first side edge seal being pinched and compressed between the support sheet metal and the development roller, wherein, in the width direction, the first end portion of the support sheet metal in the axial direction is shorter than the center portion of the support sheet metal in the axial direction, the width direction being a direction from the base end portion of the support sheet metal toward the distal end portion of the support sheet metal, wherein, in the width direction, a distal-end edge of the first end portion of the support sheet metal is closer to the base end portion of the support sheet metal than a distal-end edge of the blade rubber section is to the base end portion, the distal-end edge of the first end portion of the support sheet metal being an edge closer to the distal end portion of the support sheet metal among two edges of the first end portion in the width direction, the distal-end edge of the blade rubber section being an edge closer to the distal end portion of the support sheet metal among two edges of the blade rubber section in the width direction, and wherein a boundary between the first side edge seal and an end face the blade rubber section in the axial direction is within the extending range of the slit when viewed from the width direction.

2. The development device according to claim 1, wherein the layer thickness regulating blade further comprises a second side edge seal supported by the second end portion of the support sheet metal in the axial direction, the second side edge seal being adjacent to the blade rubber section in the axial direction, the second side edge seal being configured to contact the circumferential surface of the development roller, the second side edge seal being pinched and compressed between the support sheet metal and the development roller, and wherein, in the width direction, a distal-end edge of the second end portion of the support sheet metal is closer to the base end portion of the support sheet metal than the distal-end edge of the blade rubber section.

3. The development device according to claim 2, wherein the second side edge seal is made of non-woven fabric, and wherein the second side edge seal in an uncompressed state is 1.0 through 1.3 times as thick as the second side edge seal compressed between the support sheet metal and the development roller.

4. The development device according to claim 1, wherein the first side edge seal is made of non-woven fabric, and wherein the first side edge seal in an uncompressed state is 1.0 through 1.3 times as thick as the first side edge seal compressed between the support sheet metal and the development roller.

5. The development device according to claim 1, wherein the blade rubber section is supported by the distal end portion of the support sheet metal in the width direction.

6. The development device according to claim 5, wherein the slit extends up to an edge of the support sheet metal in the axial direction.

7. The development device according to claim 6, further comprising:

a first attachment sheet metal fixed to the housing; and a second attachment sheet metal fixed to the housing, wherein the support sheet metal has a fixed section configured to be fixed to the housing when pinched between the first attachment sheet metal and the second attachment sheet metal, and wherein the slit has:

a first portion extending along the axial direction up to the edge of the support sheet metal in the axial direction; and a second portion extending from the first portion toward the fixed section.

8. The development device according to claim 7, wherein the fixed section extends along the axial direction, the fixed section having a first end part and a second end part in the axial direction, the second end part being spaced apart from the first end part in the axial direction, and wherein the blade rubber section is positioned between the first end part and the second end part of the fixed section, in the axial direction.

9. The development device according to claim 1, further comprising:

a first attachment sheet metal fixed to the housing; and a second attachment sheet metal fixed to the housing, wherein the support sheet metal has a fixed section configured to be fixed to the housing when pinched between the first attachment sheet metal and the second attachment sheet metal, the fixed section extending along the axial direction, the fixed section having a first end part, a second end part, and a middle part in the axial direction, the second end part being spaced apart from the first end part in the axial direction, the middle part being positioned between the first end part and the second end part in the axial direction, wherein the blade rubber section is supported by the distal end portion of the support sheet metal in the width direction, the blade rubber section being positioned between the first end part and the second end part of the fixed section, in the axial direction, and wherein a distance in the width direction between the first end part of the fixed section and the blade rubber section and a distance in the width direction between the second end part of the fixed section and the blade rubber section are longer than a distance in the width direction between the middle part of the fixed section and the blade rubber section.

10. The development device according to claim 1, further comprising:

a first attachment sheet metal fixed to the housing; and a second attachment sheet metal fixed to the housing, wherein the support sheet metal has a fixed section configured to be fixed to the housing when pinched between the first attachment sheet metal and the second attachment sheet metal, wherein the blade rubber section is supported by the distal end portion of the support sheet metal in the width direction, the blade rubber section having a first end part and a second end part in the axial direction, the second end part being spaced apart from the first end part in the axial direction, and wherein the fixed section is positioned between the first end part and the second end part of the blade rubber section, in the axial direction.

11. The development device according to claim 1, wherein the blade rubber section is formed on a surface of the support sheet metal.

* * * * *